US008166686B2

(12) United States Patent
Junkins

(10) Patent No.: US 8,166,686 B2
(45) Date of Patent: May 1, 2012

(54) CUP LABELING SYSTEM

(76) Inventor: Mitch Junkins, Newport Beach, CA (US)

( * ) Notice: Subject to any disclaimer, the term of this patent is extended or adjusted under 35 U.S.C. 154(b) by 20 days.

(21) Appl. No.: 12/249,914

(22) Filed: Oct. 11, 2008

(65) Prior Publication Data

US 2009/0095648 A1 Apr. 16, 2009

Related U.S. Application Data

(60) Provisional application No. 60/979,284, filed on Oct. 11, 2007.

(51) Int. Cl.
*G09F 3/00* (2006.01)

(52) U.S. Cl. ..... 40/324; 40/306

(58) Field of Classification Search ..... 40/306, 40/310, 324

See application file for complete search history.

(56) References Cited

U.S. PATENT DOCUMENTS

| | | | | | |
|---|---|---|---|---|---|
| 581,494 | A * | 4/1897 | Schwab | 40/310 |
| 1,049,646 | A * | 1/1913 | Barnesby | 40/310 |
| 1,054,826 | A * | 3/1913 | Cole | 40/306 |
| 2,082,320 | A * | 6/1937 | Berman | 40/310 |
| 2,091,346 | A * | 8/1937 | Wright | 40/310 |
| 2,096,960 | A * | 10/1937 | Colby | 40/638 |
| 3,110,121 | A * | 11/1963 | Corrinet | 40/312 |
| 4,268,567 | A * | 5/1981 | Harmony | 428/195.1 |
| 4,318,235 | A * | 3/1982 | Augeri | 40/306 |
| 4,518,639 | A * | 5/1985 | Phillips | 206/579 |
| 4,551,373 | A * | 11/1985 | Conlon | 428/43 |
| 4,901,457 | A * | 2/1990 | Chandler | 40/306 |
| 5,329,713 | A * | 7/1994 | Lundell | 40/310 |
| 5,484,167 | A * | 1/1996 | Donaldson et al. | 283/67 |
| 5,788,076 | A * | 8/1998 | Simmons | 206/459.5 |
| 5,857,615 | A * | 1/1999 | Rose | 229/403 |
| 6,047,488 | A * | 4/2000 | Tuszkiewicz | 40/306 |
| 6,315,192 | B1 * | 11/2001 | Marlow | 229/401 |
| 6,622,878 | B1 * | 9/2003 | Frey | 215/12.2 |
| 6,709,726 | B1 * | 3/2004 | Dronzek et al. | 428/40.1 |
| 6,991,261 | B2 * | 1/2006 | Dronzek et al. | 283/81 |
| 2005/0229450 | A1 * | 10/2005 | Larsen et al. | 40/310 |
| 2007/0028491 | A1 * | 2/2007 | Panella | 40/324 |

OTHER PUBLICATIONS

"Baking Powder," http://www.flickr.com/photos/zonagir1/137998448/, Apr. 30, 2006.*

* cited by examiner

*Primary Examiner* — Gary Hoge

(74) *Attorney, Agent, or Firm* — Hani Z. Sayed; Rutan & Tucker, LLP

(57) ABSTRACT

An apparatus and a system for affixing a label to a cup, bottle and/or container is provided. The apparatus and system may allow for affixing a pre-printed label having a plurality of colors and indicia thereon to a cup whereby the label may be viewed as integral part to the cup itself. The preprinting of the labeling prior to the affixation of the cup insures consistency and uniformity of the indicia thereon. Additionally, the printing of the label prior to affixing it to the cup may allow the printer to ensure proper angles of the indica prior to the application of the label onto the desired cup apparatus. Moreover, the present invention may allow for the peeling away of a portion if the label to review the outside edge of the receiving cup/container.

17 Claims, 2 Drawing Sheets

CUP LABELING SYSTEM

CROSS REFERENCE TO RELATED APPLICATION

This application claims priority from U.S. Provisional Patent Application Ser. No. 60/979,284 filed Oct. 11, 2007, which is hereby incorporated herein by reference in its entirety.

FIELD OF THE INVENTION

The field of the invention is for the labeling of cup. More specifically, the field of invention is for an apparatus and a system for labeling a cup with a preformed label applied to a standard cup.

BACKGROUND

Cups, bottles and containers have been labeled for years. The labeling helps the consumer identify the brand and quality of the contents of the container. Additionally, the labeling may also help advertise the product to other potential consumers. Many labels on cups, bottles and containers are multi-colored and have different indicia printed thereon. Moreover, the labels may also contain names, brands, colors, bar codes, ingredients and the like.

One of the primary problems with labeled containers is that most printing apparatuses are not capable of printing all the necessary or desired information onto the cup at one time. For example, if the cup requires a multi-colored label, typically, one color is applied at a particular time and then a subsequent second color is applied to the cup. However, the problem with this type of labeling is that if the alignment of the two colors is off, the entirety of the label may look distorted and can cloud the visibility of the product label to the consumer. Moreover, with mis-alignment, it may project a weak or feeble product to the consumer. Therefore, it is often very important to the producer to provide proper alignment and configuration of the label about the cup.

Other types of labels have been utilized such as the peel off label and the wrap around label that is glued to the cup, bottle or container. These types of labels are affixed to the container and are typically printed in advance of placement of the label onto the container. A significant problem with these types of labels is that they tend to distort because of the angles in which the label is printed is not the same angels when applied to the cup, causing the lack of uniformity and customization for the cup label.

Additional prior art labels are slid into place about the container when desired by the manufacturer. The label may be manufactured as a separate piece, sized slightly larger than the cup such that it may be slid onto the container after it is manufactured. Additionally, because of the size differences between the cup and the label, the label is affixed to the cup by size and frictional forces. No other affixation substance is needed such as glue, tape or the like. However, a problem with this type of labeling is that the label may slide away from the cup if not properly affixed, or the frictional forces are not adequate. Additionally, constant re-adjustment of the label is necessary to keep the label in place on the cup because there is no affixation substance utilized to keep the label in place.

Therefore a need exists for a labeling apparatus and system that may be easily applied to a container whereby the labeling system may be applied after the container has been manufactured and may be pre-printed and affixed to the container in such a manner that the label looks integral to the container.

Additionally, a need exists for a labeling system that may have a portion thereof which may be removed from the label, revealing a portion of top layer of the cup to a consumer.

SUMMARY OF THE INVENTION

The present invention provides an apparatus and a system for affixing a label to a cup, bottle and/or container. Additionally, the present invention provides an apparatus and a system for affixing a pre-printed label having a plurality of colors and indicia thereon onto a cup whereby the label may be viewed as integral to the cup itself and further wherein the preprinting of the labeling prior to affixation to the cup insures consistency, proper angles and uniformity of the indicia thereon. Moreover, the present invention may allow for the peeling away of a portion of the label to review the outside edge of the cup.

To this end, in an exemplary embodiment of the present invention, a system for use in conjunction with a container is provided. The system has a preprinted label having an outside portion, an inner edge and at least an inner portion whereby the inner portion has indicia thereon. The system also provides a container to be utilized by an end consumer and a preprinted label which is removably affixed to a container.

In an exemplary embodiment, the system has a pre-printed label whereby the inside portion is configured to have an adhesive thereon.

In an exemplary embodiment, the system has a pre-printed label whereby the inside portion is configured to be affixed to an outside portion of the container.

In an exemplary embodiment, the system has a pre-printed label whereby the preprinted label has an inner portion whereby the inner portion has indicia thereon and the outer portion has indicia thereon.

In an exemplary embodiment, the system has a pre-printed label whereby the preprinted label is constructed of a suitable material whereby the material is plastic.

In an exemplary embodiment, the system has a pre-printed label whereby the preprinted label is constructed of a suitable material whereby the material is paper.

In an exemplary embodiment, the system has a pre-printed label whereby the preprinted label has a plurality of peelable portions thereon to review the inner portion of the label.

In an exemplary embodiment, the system has a pre-printed label whereby the preprinted label has an outside portion which conceals the inner portion during use.

In an exemplary embodiment, the system has a pre-printed label whereby the pre-printed label has a tear away line whereby the tear away line allows for tearing of the outside portion of the label to reveal information contained on the inner portion of the label.

In an exemplary embodiment, the system has a pre-printed label whereby the pre-printed label has a plurality of tear lines to allow for tearing away of the outside portion of the label to reveal the indicia contained on the inner portion of the label.

In an exemplary embodiment, the system has a pre-printed label whereby the pre-printed label has a plurality of tear lines thereon whereby the tear lines allow for tearing away at least a portion of the outside portion, inner portion and inner edge of the label to reveal the outside edge of the container.

In an exemplary embodiment, the system has a container whereby the container has indicia printed thereon.

In an exemplary embodiment, the system has a pre-printed label whereby the label is removably attached to the container and further wherein the label may be replaced with another subsequent label when desired by a user.

In an exemplary embodiment, the system has a pre-printed label whereby the pre-printed label is a heat insulating shield to provide heat insulating from a hot container.

To this end, in an exemplary embodiment of the present invention, a method of providing information on a container is provided. The method comprising the steps of: providing a container which is utilized to carry a substance; providing a pre-printed label having an inside edge, an outer edge and an inner portion whereby the outer edge of the pre-printed label having indicia thereon; and removably attaching the pre-printed label to an outside portion of the container.

In an exemplary embodiment, the method further comprises the step of: incorporating an indicia onto the outside portion of the container.

In an exemplary embodiment, the method further comprises the step of: providing the pre-printed label having at least an indicia on the outer edge of the label and the inner portion of the label.

In an exemplary embodiment, the method further comprises the step of: providing the pre-printed label having at least an indicia on the outer edge of the label and the inner portion of the label whereby the indicia on the outer edge of the label and the indicia on the inner portion of the label are dissimilar and distinct from one another.

In an exemplary embodiment, the method further comprises the step of: providing at least a tear line whereby an individual user may utilize the tear line to reveal the inner portion of the label which is concealed by the outer edge of the label.

In an exemplary embodiment, the method further comprises the step of: allowing for removal and replacement of the label from the container with another subsequent pre-printed label.

Among the many different possibilities contemplated, the system may allow for multiple configurations of the label about the cup and/or container.

Additionally, in an exemplary embodiment, the system may be configured to have a plurality of removable parts therefrom.

In another exemplary embodiment, it is contemplated that the system may be configurable to have a label with multiple colors printed thereon.

In yet another exemplary embodiment, it is contemplated that the system may be configurable to have a label having a plurality of colors and indicia thereon.

A further exemplary embodiment contemplates that the system may have a label constructed of a suitable material such as plastic.

In another exemplary embodiment, it is contemplated that the system may have a label constructed of any suitable material such as paper, wax, plastic and the like.

Further, a contemplated embodiment of the system may have an outer portion and an inner portion whereby the outer portion of the label may be adapted to receive printed indicia thereon.

Additionally, in an exemplary embodiment, the system may have an outer portion and an interior portion wherein the inner portion may be adapted to fit against the outside edge of the receiving cup.

In yet another exemplary embodiment, it is contemplated that the system may have a label having an inner portion whereby the inner portion may have an adhesive thereon for attachment and affixation to the outside edge of the receiving cup.

Yet another exemplary embodiment of the present invention may include an apparatus and a system for attaching a label to a cup.

In an exemplary embodiment of the present invention, an apparatus and a system is provided wherein a label is printed prior to affixation to a receiving cup.

Another exemplary embodiment of the present invention may include an apparatus and a system for pre-printing and attaching a label to a receiving cup after manufacture of the cup such that the label is perceived to be integral to the cup.

Various objects, features, aspects and advantages of the present invention will become more apparent from the following detailed description of preferred embodiments of the invention, along with the accompanying drawings in which like numerals represent like components.

DETAILED DESCRIPTION OF THE PRESENT INVENTION

Figure 1:
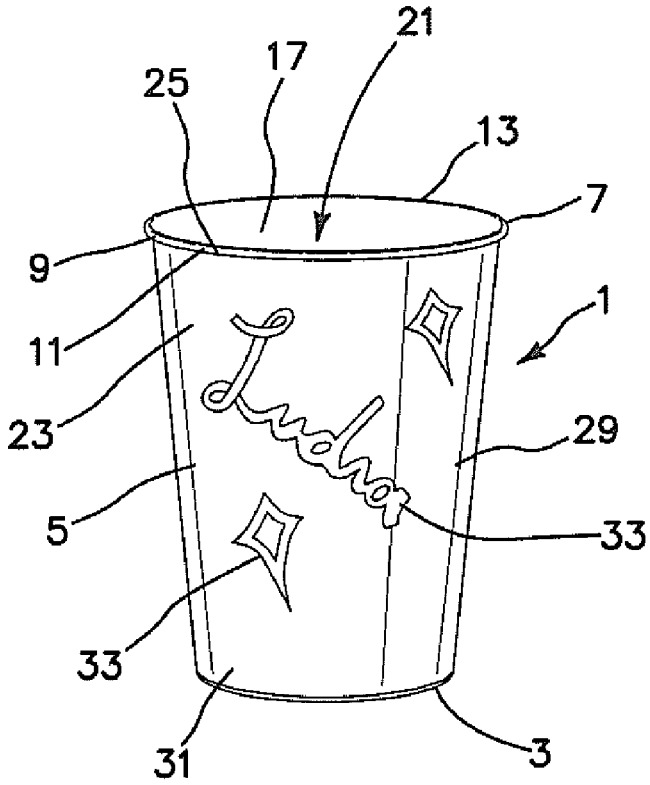
FIG. 1 is a perspective view of the invention illustrating the system in an exemplary embodiment of the present invention.

Turning now to the Figures where like numbers represent like elements, FIG. 1 illustrates a perspective view of the cup labeling system in an exemplary embodiment of the present invention. As illustrated, the cup 1 may have at least a bottom portion 3 which may be integrally attached to at least a side wall portion 5. A top lip 7 may also be positioned on the top area 9 of the cup 1. The top lip 7 may have a ledge portion 19 which may allow for retention of fluids contained therein. Moreover, the top lip may provide the area for allowing an individual to receive liquid/or solids from the inside of the cup. It should be understood that the present invention generally relates to a cup, however, any structure that may provide for storage and receipt of a fluid, solid, or other material which a user wishes to store has been contemplated. The present invention is in no way limited to the embodiment disclosed herein, however for ease of understanding and to provide at least one preferred exemplary embodiment, a cup system is described. The top lip 7 may preferably have at least an outside edge 11 and an inside edge 13 whereby the inside edge 13 is connected to the inside wall 15 of the cup 1. Further the inside edge 13 defines the opening 17 formed in the top area 9 of the cup 1. The opening 17 may be provided to allow for insertion and extraction of a material stored in the interior portion 21 of the cup 1.

Again, it should be understood that the illustration used herein, mainly a cup, is not limited to such a structure and may include a plurality of different storage receptacles. Moreover, for ease of explanation, it should be understood that a fluid may be one of the desired storage materials to be stored in the interior portion 21 of the cup 1. However, the present invention is not limited to the storage of fluids and may be utilized with any material to be stored.

FIG. 1 further illustrates the side wall portion 5 of the cup whereby the side wall portion 5 may be generally cylindrical in shape. However, as call be appreciated by those of ordinary skill in the art, the side wall portion 5 may have a plurality of different structures including triangular, rectangular, trapezoidal, square and the like. Additionally, with the plurality of different shapes and sizes of the cup 1, the side wall portion 5 may have a plurality of sides (not shown). The side wall portion 5 may obviously vary depending on the size and shape of the cup 1 structure. However, the side wall portion 5 generally takes up the entire area from the bottom portion 3 of the cup 1 to the top lip 7 of the cup 1. Thereby the side wall portion 5 generally presents the largest viewing surface to the individual user. The side wall portion may have a first side 23 and a second side 25. The second side 25 facing the interior portion 21 of the cup 1, while the first side 23 may face the exterior portion 29 of the cup. The first side 23 may also come in contact with a label 31 which may be applied to the first side 23 of the side wall 5 of the cup 1. The label 31 may be separately constructed from the cup 1 and may be applied after the cup 1 has been constructed. The label 31 may also be constructed integral to the cup 1. However, in an exemplary embodiment of the present invention, the label is preferably constructed separately and applied to the cup 1 after the cup 1 construction. Additionally, the label 31 may have a plurality of indicia 33 thereon whereby the indicia 35 may provide information, advertising or other information.

Figure 2:
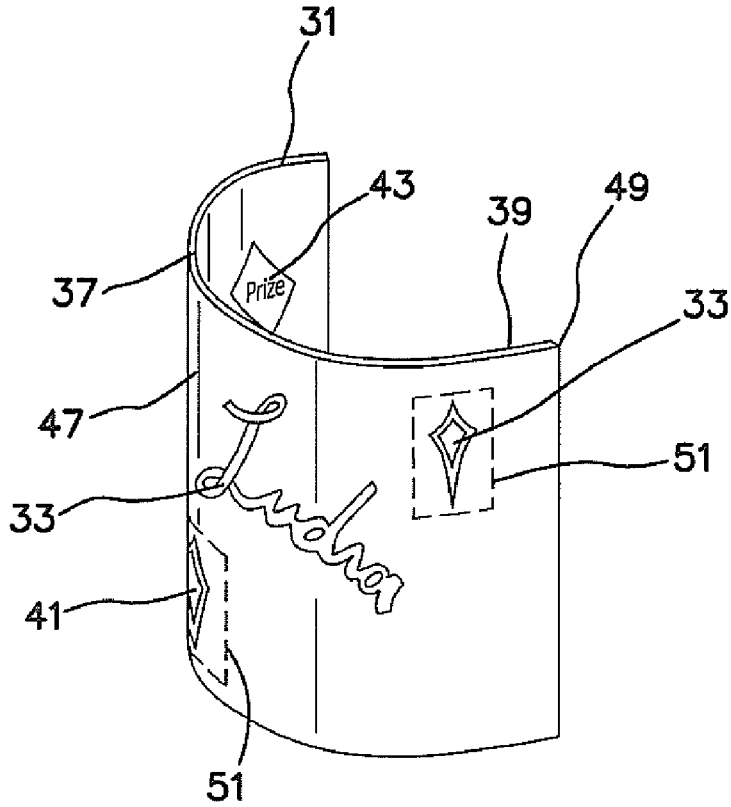
FIG. 2 is a perspective view of the label on the container in an exemplary embodiment of the present invention.

FIG. 2 illustrates the label 31 having the indicia 33 thereon separate from the cup system 1. The label 31 may be constructed of any of a plurality of materials, including paper, wood, metals, plastic, wax and the like. Additionally, the label 31 would preferably be maliable enough to be affixed to a plurality of different sized and shaped cups 1. Additionally, it is preferable that the label 31 be constructed to fit the exact or substantially the exact dimensions of the cup 1 to which it is to be applied. In an exemplary embodiment, the label 31 would be constructed to fit the external dimensions of the side wall 5 of the cup 1 and would preferably take up the entire outside side wall 5 of the cup 1 when applied and/or affixed to the cup 1.

Referring again to FIG. 1, the cup 1 may have the label 31 affixed to the outside edge of the cup 1 whereby the label 31 may take up a substantial portion or in an exemplary embodiment, the entire side wall 5 of the cup 1 may be taken up by the label 31. Again referring to FIG. 2, in an exemplary embodiment, the label 31 may at least a first layer 37 and a second layer 39. The first layer 37 may have a printed indicia 41 thereon and the second layer 39 may also have a second indicia 43 printed thereon. In an exemplary embodiment, the first layer 37 is contained on the outer edge 47 of the label 31 whereby the second layer 39 may be contained on the inside edge 49 of the label 31. Additionally, the first layer 37 may completely conceal the second layer 39 until uncovered by the individual user. Moreover, a tear line 51 may be provided on the label 31 whereby the tear line 51 may allow for tearing way of the first layer 37 in relation to the second layer 39 of the label 31. The tear line 51 may allow the individual user to tear off at least a part of the first layer 39 having a first indicia 41 thereon to reveal the second Layer 39 which is beneath the first layer 37. Upon tearing away the first layer 37 to reveal the second layer 39 underneath the first layer 37, the individual user and/or viewer will be allow to see the second indicia 43 which may be printed on the second layer 39 of the label 31.

Figure 3:
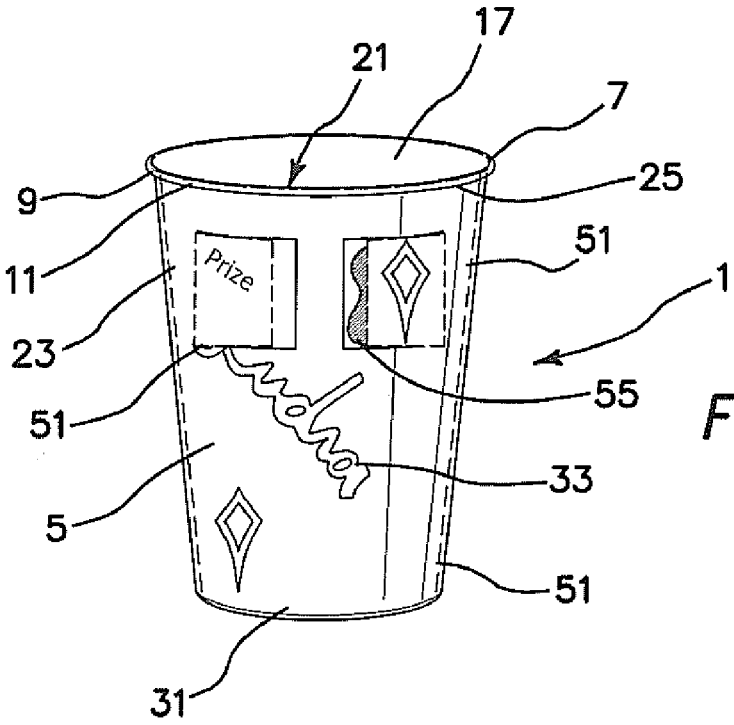
FIG. 3 is a cross sectional view of the apparatus in an exemplary embodiment of the present invention.

As further illustrated in FIGS. 2 and 3, a plurality of tear lines 51 may be provided to illustrate a plurality of second indicia 43 which are printed on the second layers 39 of the label 31. Thereby the individual or company that constructs the cup 1 and/or label 31 may put a plurality of different indicia 43 on the second layer 39 of the label 31. Further, an advantage of having a plurality of indicia 43 on a second layer 39 allows the individual or company that constructs the cup 1 and/or label 31 to put a plurality of different information thereon. For example, the second layer 39 may have different promotional information contained thereon including prizes, coupons, etc. which may be utilized to entice consumers to purchase their products. Further the second layer 39 may have a plurality of advertising information which may advertise products, goods, and services from a different provider, thereby generating income for the individual and/or company that either constructs the cup 1 and/or label 31 or may generate income for the individual and/or company which commissions the construction of the same. For example, Company A may request that a plurality of cups be constructed having both the first and second layers 37, 39. Company A may also request that at least some information or indicia 43 on the second layer 39 of the label 31 contain information relating to goods and services provided by Company B whereby Company B may pay an advertising fee for expose to Company A's consumer that may be utilizing their cups 1 having a label 31 contained thereon.

FIG. 3 illustrates the same label 31 and cup 1 wherein the label 31 may have a plurality of tear lines 51 wherein the tear lines 51 may be utilized to illustrate indicia 43 which may be contained under the first layer 37 of the label 31. However, in an alternative exemplary embodiment, it is contemplated that the label 31 may have a first layer 31 and at least a tear line 51. However no second layer 39 of the label 31 is provided. Instead, indicia 55 may be printed directly onto the side wall 5 of the cup. The label 31 may be strategically placed onto the side wall 5 of the cup 1 whereby the tear lines 51 may be aligned to be able to show the indicia 55 contained on the side wall 5 of the cup 1. Thereby, when a user desires to tear away the first layer 37 of the label 31, the tear line 51 may be utilized to tear away the first layer 37 of the label 31 which will reveal the indicia 55 contained on the pre-existing side wall 5 of the cup 1. Thereby a producer of the cup 1 may allow for the cup 1 to have existing indicia thereon and further wherein the label 31 may be affixed to the cup 1 after construction of the entire cup 1 unit.

Figure 4:
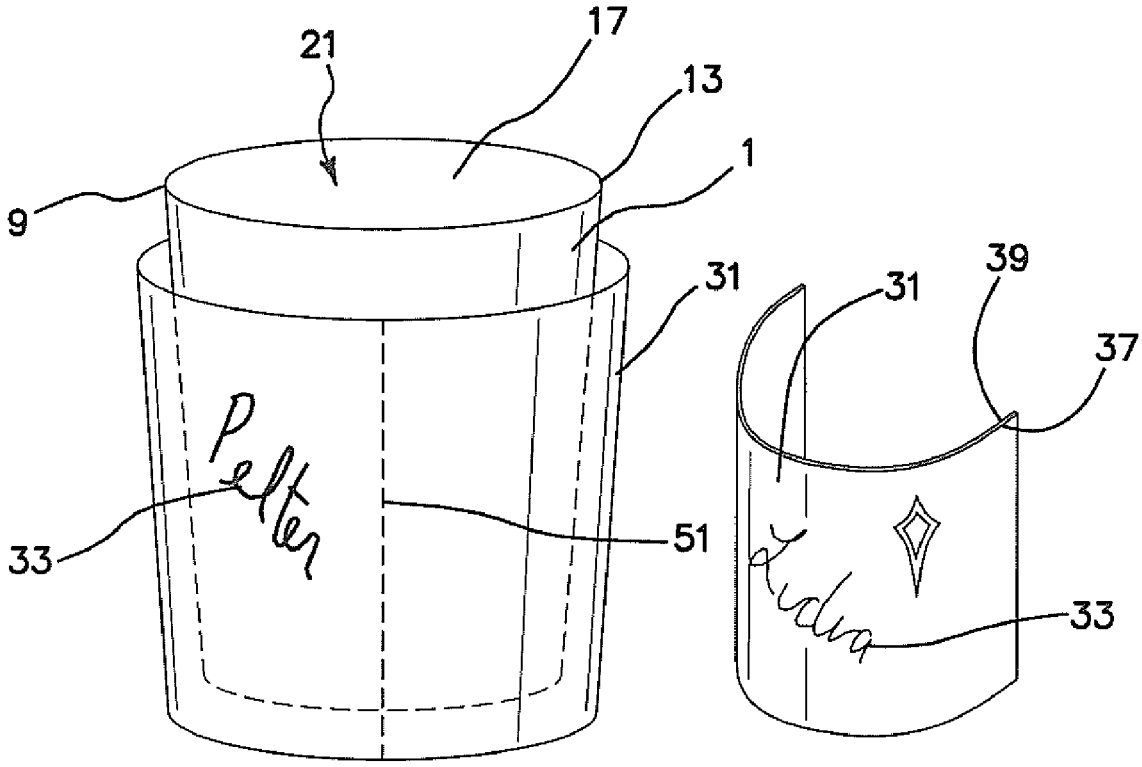
FIG. 4 is a perspective view of the cup and plurality of labels in an exemplary embodiment of the present invention.

As illustrated in FIG. 4, it is further contemplated that the label 31 may be replaceable by the end user. For example, many cups may be fabricated for multiple uses. These cups are often carried by the individual user and re-filled with the desired liquid at will. It would be advantageous to allow for a label 31 to be placed above the outside surface of the cup 1. This may allow for advertising of a product or service, or temporary replacement of the indicia on the existing cup with another indicia 55. Further, the placement of temporary labels 31 thereon may provide for promotional information to be placed on the existing cup without the need to replace the cup 1. Moreover, an advertiser may wish to promote certain products or services that provide special information and/or give coupons and discounts to the end user. This may be easily provided to simply providing the label made to fit the existing cup 1, whereby the label may have a tear line 51 which may allow for replacement of the label 31 when desired by both the individual user and the promoter of the label 31. Further, another promotional embodiment which may be provided by the label 31 is the possibility of game play. Many retailers and businesses like to entice individual consumers with the ability to play a game in the possibility of receiving or being awarded a prize. These prizes are often part of a promotional item, including a cup 1. The present invention may further be utilized to play a game having a plurality of game pieces on the label 31 having tear away 51 lines which may allow the individual user to tear the entire label 31 from the cup without having to deform the cup 1 or even to provide indication that the cup has been used or is being discarded. Further, the cup 1 may be re-used because the game piece may be located entirely on the label 31 either on the first layer 37 or, alternatively on the second layer 39. Further, having the entire game piece of the label 31, allows for construction of a consistent cup without the need to alter the cup to produce the cup having promotional indicia 55 thereon, thereby cutting down the costs to produce new and revised cups having the promotional material thereon. Moreover, because new cups 1 do not need to be produced, it is contemplated that rollouts of promotional materials may happen in a much more timely manner than if new promotional cups had to be produced first. Further, individual locations for a retailer or a wholesaler would be able to install the label 31 prior to shipment to the end user.

Thus, specific embodiments and applications of modular overhead storage have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C, . . . and N, the text should be interpreted as requiring only one element from the group, not A plus N, or B plus N, etc.

I claim:

1. A system for use in conjunction with a container, the system comprising:

a preprinted label having an outside portion, and an inner portion whereby the preprinted label has an inner edge whereby both the outside portion and the inner portion of the preprinted label have indicia thereon and further wherein the indicia on the outside portion of the preprinted label conceals the indicia on the inner portion until uncovered by a user;

a container to be utilized by an end consumer wherein the container has indicia printed thereon wherein the preprinted label conceals the indicia on the container until uncovered by a user;

the preprinted label being placed above the outside edge of the container wherein the preprinted label encompasses the entirety of the a side wall of the container whereby said preprinted label being removably affixed to a container;

said label is replaceable with another subsequent preprinted label while still retaining the indicia printed on the container; and wherein said preprinted label has a plurality of peelable portions thereon to review an inner layer of the label, the peelable portions lining up with specific promotional indicia on the container.

2. The system described in claim 1 wherein said inner portion is configured to have an adhesive thereon.

3. The system described in claim 1 wherein said inner portion is configured to be affixed to an outside portion of the container.

4. The system described in claim 1 wherein said preprinted label is constructed of a suitable material whereby the material is plastic.

5. The system described in claim 1 wherein said preprinted label is constructed of a suitable material whereby the material is paper.

6. The system described in claim 1 wherein said preprinted label has a plurality of peelable portions thereon to review the inner portion of the label.

7. The system described in claim 1 wherein the preprinted label has an outside portion which conceals the inner portion during use.

8. The system described in claim 1 wherein the pre-printed label has a tear away line whereby the tear away line allows for tearing of the outside portion of the label to reveal information contained on the inner portion of the label.

9. The system described in claim 1 wherein the pre-printed label has a plurality of tear lines to allow for tearing away of the outside portion of the label to reveal the indicia contained on the inner portion of the label.

10. The system described in claim 1 wherein the preprinted label has a plurality of tear lines thereon whereby the tear lines allow for tearing away at least a portion of the outside portion, inner portion and inner edge of the label to reveal the outside edge of the container.

11. The system described in claim 1 wherein the preprinted label is a heat insulating shield to provide heat insulating from a hot container.

12. A method of providing information on a container, the method comprising the steps of:

providing a container which is utilized to carry a substance the container having indicia contained thereon;

providing a pre-printed label having an inside edge, an outer edge and an inner portion whereby the preprinted label has an inner edge whereby both the an outside portion and the inner portion of the preprinted label have indicia thereon and further wherein the indicia on the outside portion of the preprinted label conceals the indicia on the inner portion and the indicia on the container until uncovered by a user, wherein said preprinted label has a plurality of peelable portions thereon to review the inner layer of the label, the peelable portions lining up with specific promotional indicia on the container; and removably attaching the pre-printed label to an outside portion of the container wherein the preprinted label being placed above the outside edge of the container wherein the preprinted label encompasses the entirety of the a side wall of the container wherein the label is replaceable with another subsequent pre-printed label while still retaining indicia printed on the container.

13. The method of claim 12 further comprising the step of:

incorporating an indicia onto the outside portion of the container.

14. The method of claim 12 further comprising the step of:

providing the pre-printed label having at least an indicia on the outer edge of the label and the inner portion of the label.

15. The method of claim 12 further comprising the step of:

providing the pre-printed label having at least an indicia on the outer edge of the label and the inner portion of the label whereby the indicia on the outer edge of the label and the indicia on the inner portion of the label are dissimilar and distinct from one another.

16. The method of claim 12 further comprising the step of:

providing at least a tear line whereby an individual user may utilize the tear line to reveal the inner portion of the label which is concealed by the outer edge of the label.

17. A system for use in conjunction with a container, the system comprising:

a preprinted label integral to a container, the preprinted label having an inner edge whereby both the outside portion and the inner portion of the preprinted label have indicia thereon and further wherein the indicia on the outside portion of the preprinted label conceals the indicia on the inner portion until uncovered by a user;

the container to be utilized by an end consumer wherein the container has indicia printed thereon wherein the preprinted label conceals the indicia on the container until uncovered by a user;

the preprinted label encompasses the entirety of the a side wall of the container whereby said preprinted label being removably affixed to a container; and wherein said preprinted label has a plurality of peelable portions thereon to review an inner layer of the label, the peelable portions lining up with specific promotional indicia on the container.

* * * * *